US010308017B2

(12) United States Patent
Matsuhashi

(10) Patent No.: US 10,308,017 B2
(45) Date of Patent: Jun. 4, 2019

(54) LIQUID DISCHARGE DEVICE AND LIQUID DISCHARGE METHOD

(71) Applicant: SEIKO EPSON CORPORATION, Tokyo (JP)

(72) Inventor: Kunihiko Matsuhashi, Matsumoto (JP)

(73) Assignee: SEIKO EPSON CORPORATION, Tokyo (JP)

( * ) Notice: Subject to any disclaimer, the term of this patent is extended or adjusted under 35 U.S.C. 154(b) by 0 days.

(21) Appl. No.: 15/327,936

(22) PCT Filed: Jul. 9, 2015

(86) PCT No.: PCT/JP2015/003477
§ 371 (c)(1),
(2) Date: Jan. 20, 2017

(87) PCT Pub. No.: WO2016/013173
PCT Pub. Date: Jan. 28, 2016

(65) Prior Publication Data
US 2017/0203563 A1 Jul. 20, 2017

(30) Foreign Application Priority Data
Jul. 22, 2014 (JP) ..... 2014-148553

(51) Int. Cl.
*B41J 2/045* (2006.01)
*B41J 3/407* (2006.01)
*B41J 29/58* (2006.01)

(52) U.S. Cl.
CPC ..... *B41J 2/04573* (2013.01); *B41J 2/04586* (2013.01); *B41J 3/4073* (2013.01); *B41J 29/58* (2013.01)

(58) Field of Classification Search
CPC .... B41J 2/04573; B41J 2/04586; B41J 11/00; B41J 2/01; B41J 2/21
See application file for complete search history.

(56) References Cited

U.S. PATENT DOCUMENTS 7,021,732 B2 * 4/2006 Folkins ..... B41J 2/0057 347/19
8,419,144 B2 * 4/2013 Castillo ..... B41J 11/0035 347/8
2016/0355025 A1 * 12/2016 Ojima ..... B41J 3/4073

FOREIGN PATENT DOCUMENTS

JP 02-185444 7/1990
JP 05-318715 12/1993
(Continued)

OTHER PUBLICATIONS

International Search Report and Written Opinion dated Sep. 29, 2015, issued in PCT Application No. PCT/JP2015/003477, filed Jul. 9, 2015.

(Continued)

*Primary Examiner* — Thinh H Nguyen
(74) *Attorney, Agent, or Firm* — Workman Nydegger

(57) ABSTRACT

In a liquid discharge device that discharges liquid while relatively rotating a medium and a discharge unit that discharges the liquid, a degradation of quality of the discharged liquid material caused by a difference of a relative moving distance between the medium and the discharge unit per unit time when the liquid is discharged is suppressed. The liquid discharge device includes a discharge unit (3) that discharges liquid from nozzles (4) to a medium (M), a rotating mechanism (14) that relatively rotationally moves the medium (M) and the discharge unit (3) around a rotation axis direction Z crossing a discharge direction of the liquid, and a control unit (6) that controls a discharge frequency of the liquid according to a relative moving distance between the medium (M) and the discharge unit (3) per unit time.

7 Claims, 11 Drawing Sheets

(56) References Cited

FOREIGN PATENT DOCUMENTS

| | | | |
|---|---|---|---|
| JP | 2000-280567 | | 10/2000 |
| JP | 2001-191514 | | 7/2001 |
| JP | 2006-335018 | | 12/2006 |
| JP | 2006-335019 | | 12/2006 |
| JP | 2009-018545 | | 1/2009 |
| JP | 2009-184118 | | 8/2009 |
| JP | 2012/187713 | | 10/2012 |
| WO | 2004009360 | A1 | 1/2004 |
| WO | 2004016438 | A1 | 2/2004 |
| WO | 2011154628 | A1 | 12/2011 |

OTHER PUBLICATIONS

European Search Report issued in EP 15824270 dated Jan. 18, 2018.

* cited by examiner

[Fig. 1]
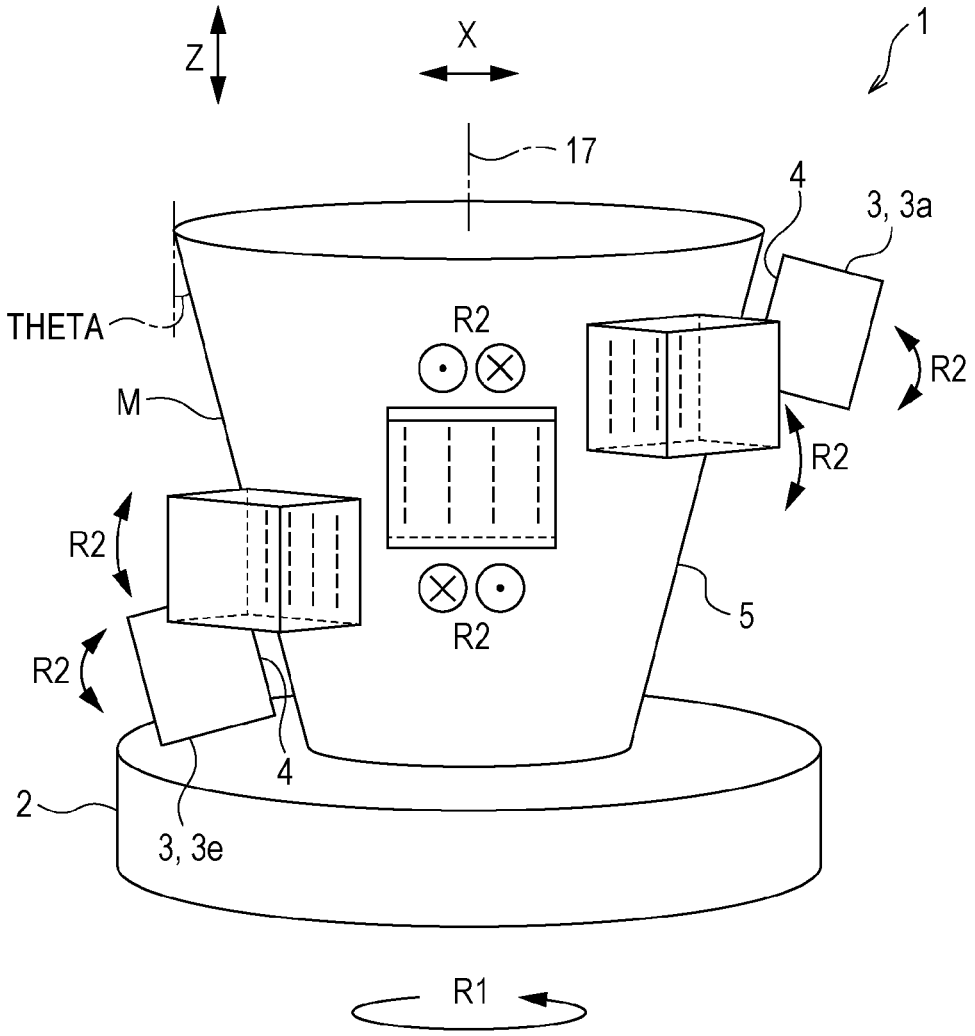

[Fig. 2]
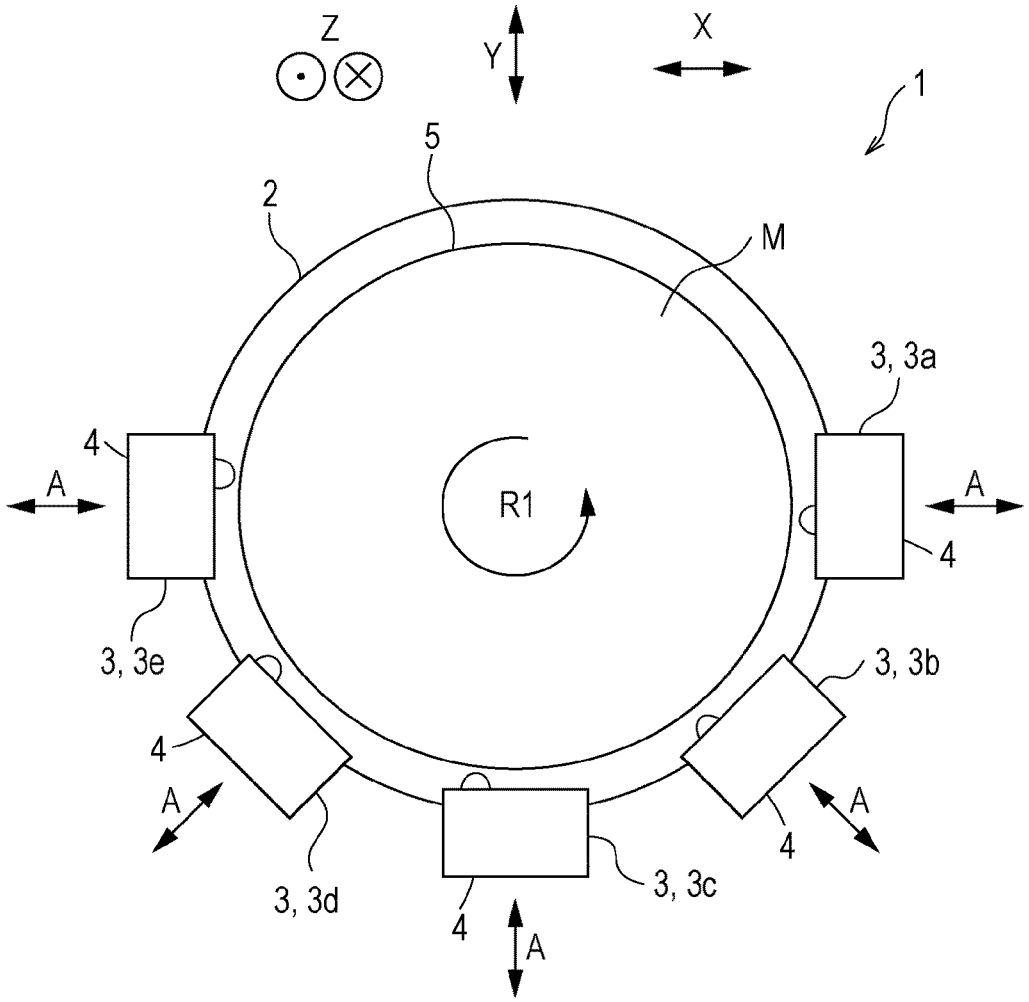

[Fig. 3]
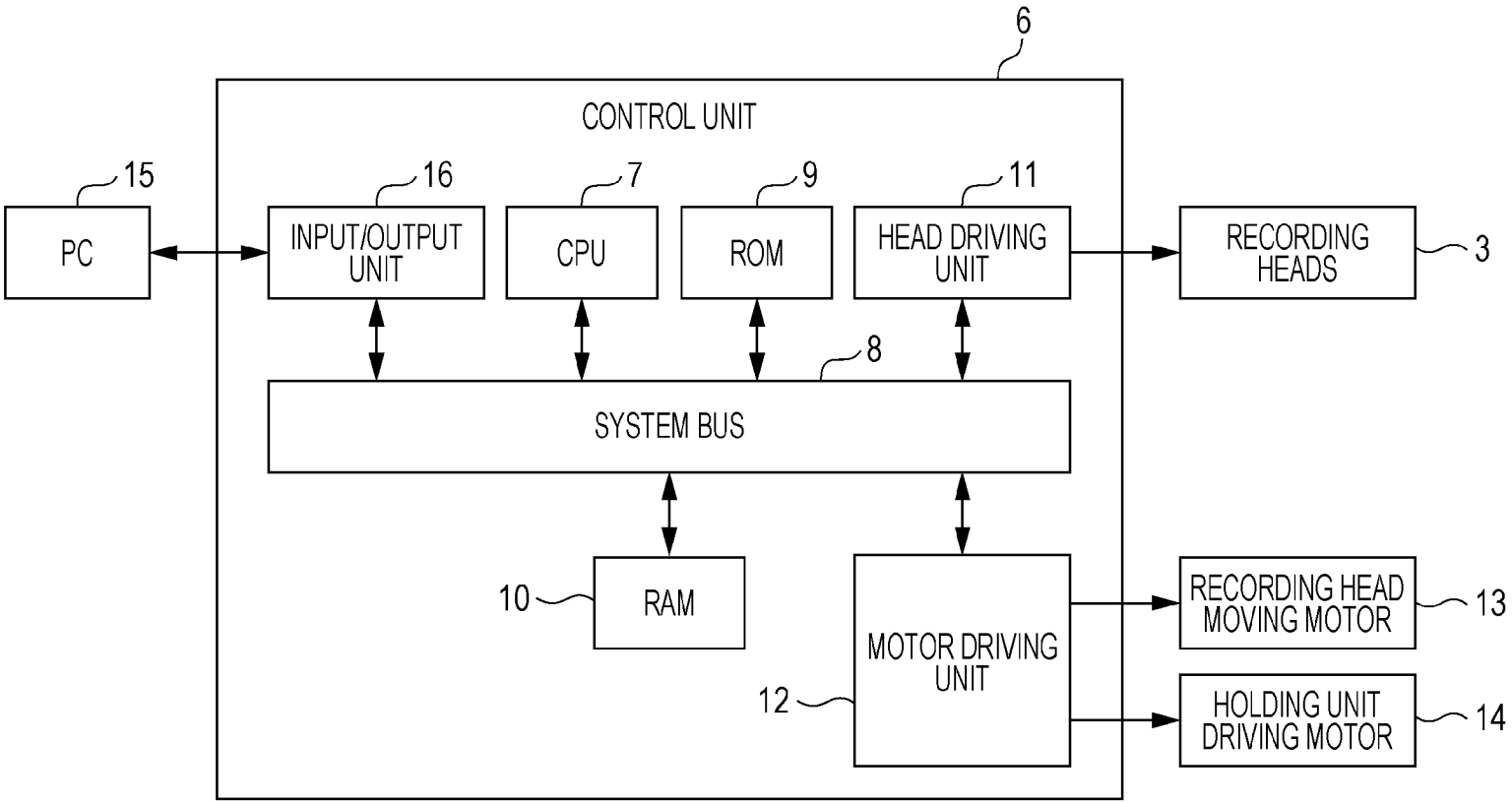

[Fig. 4]
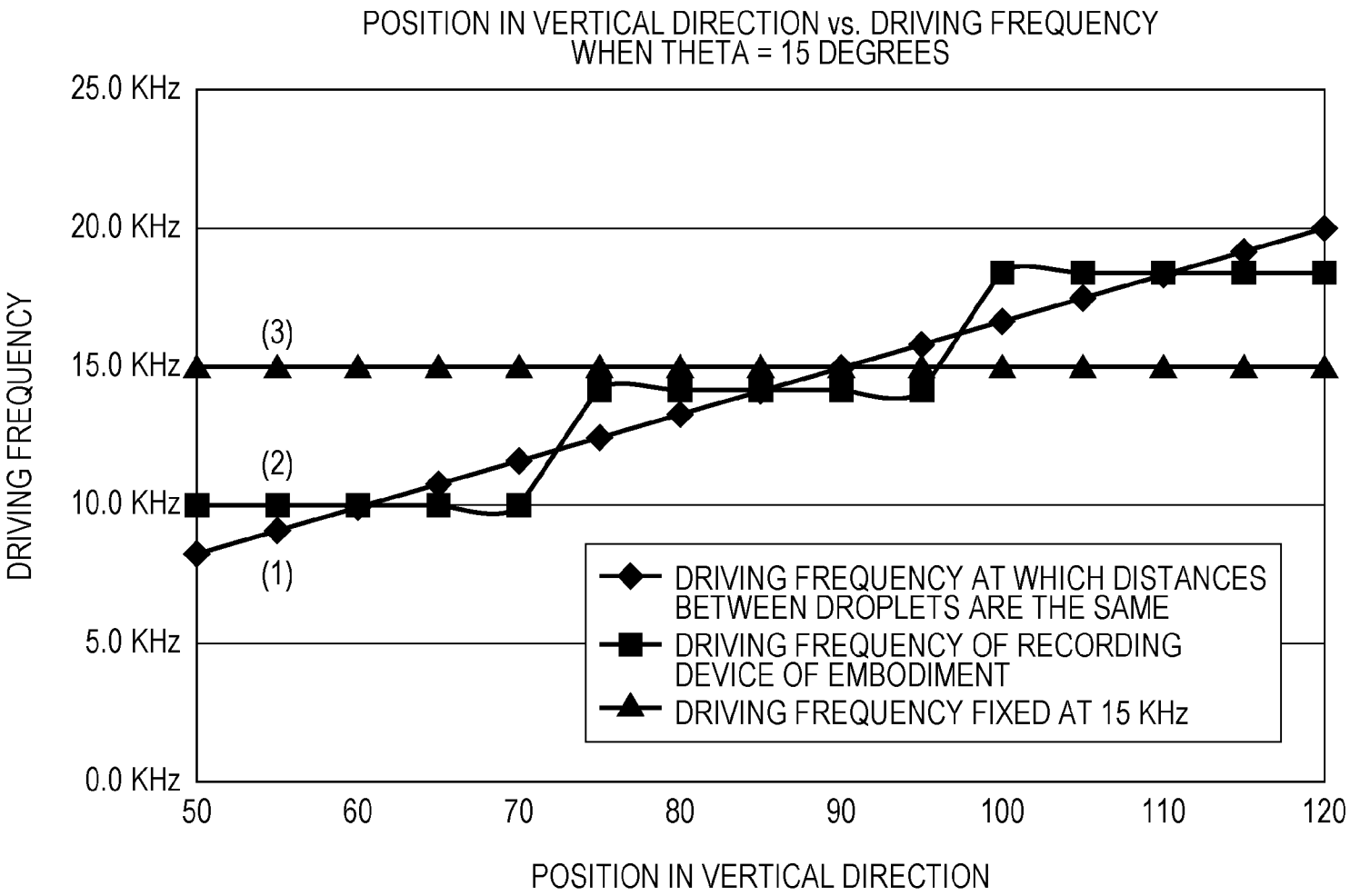

[Fig. 5]
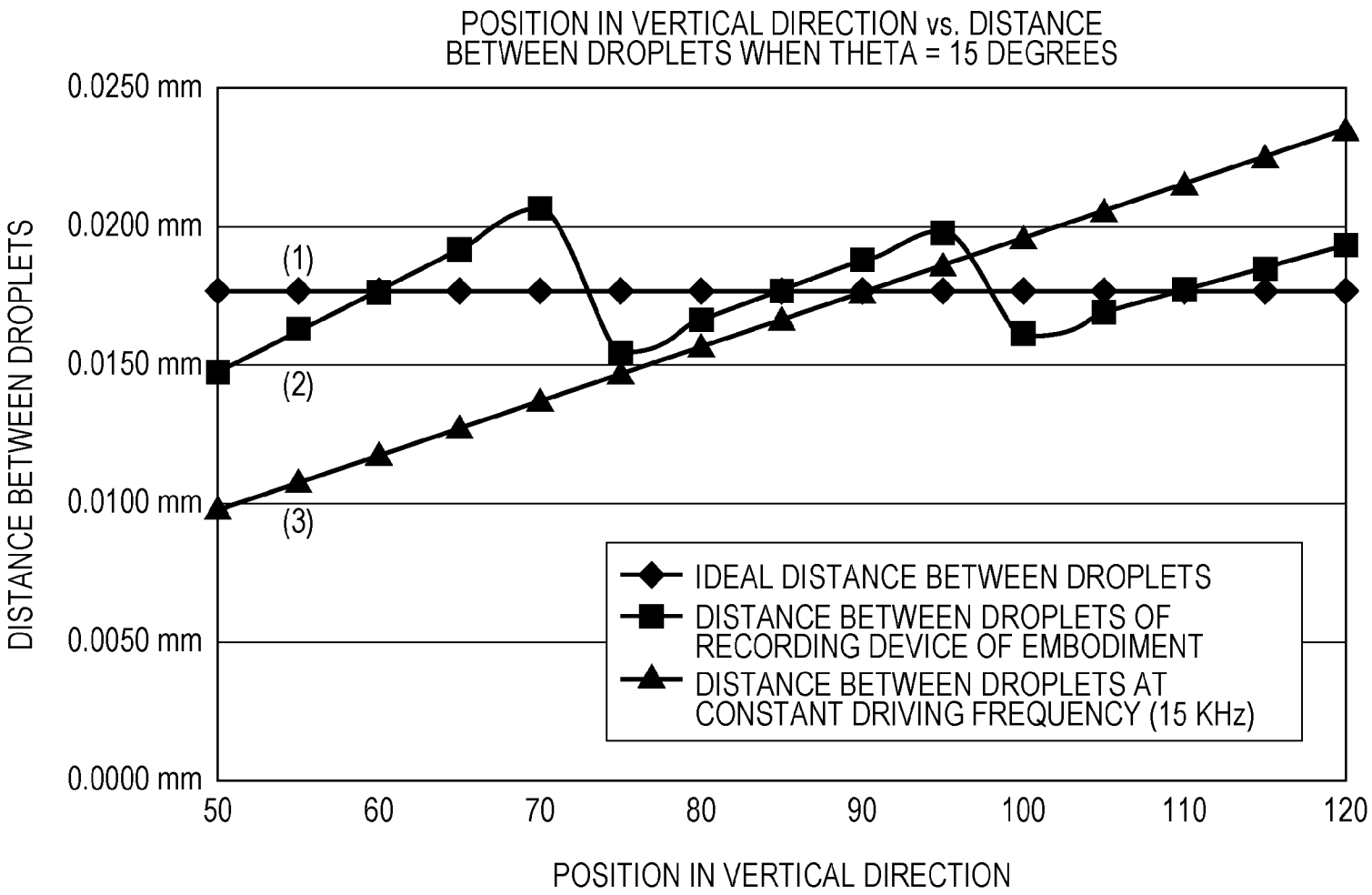

[Fig. 6]
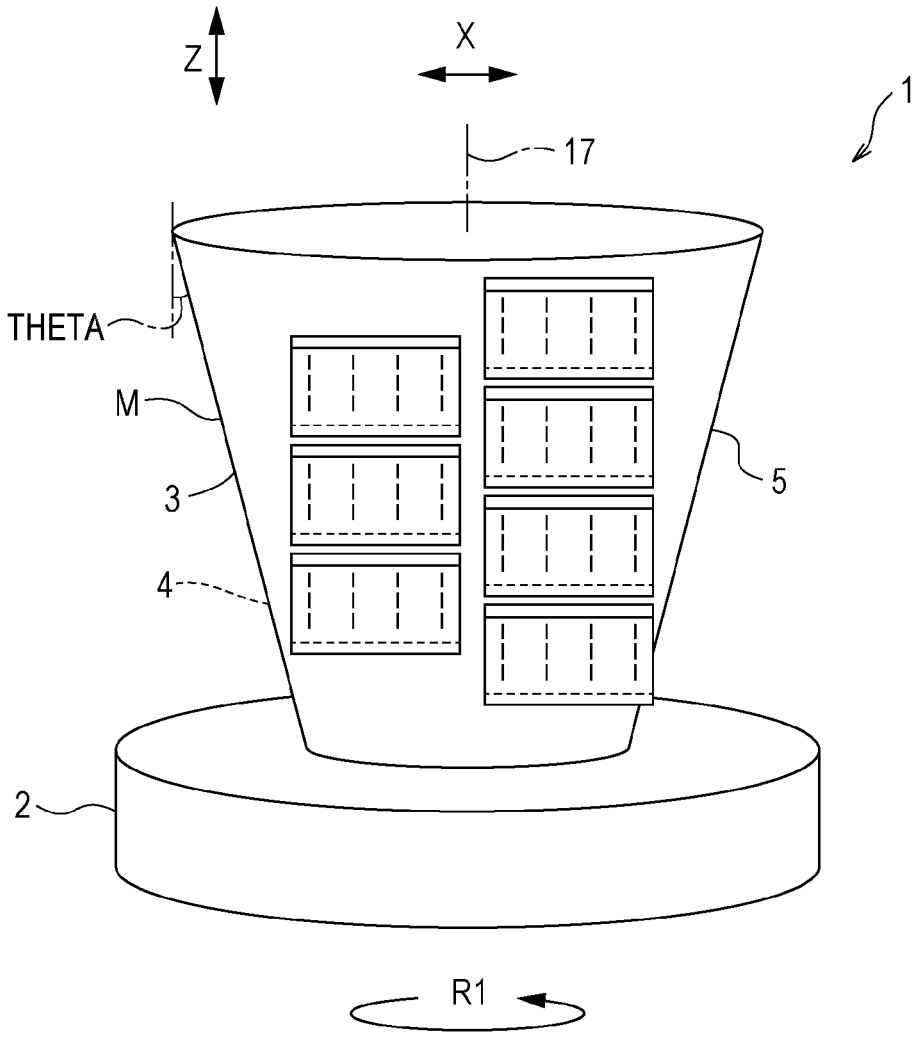

[Fig. 7]
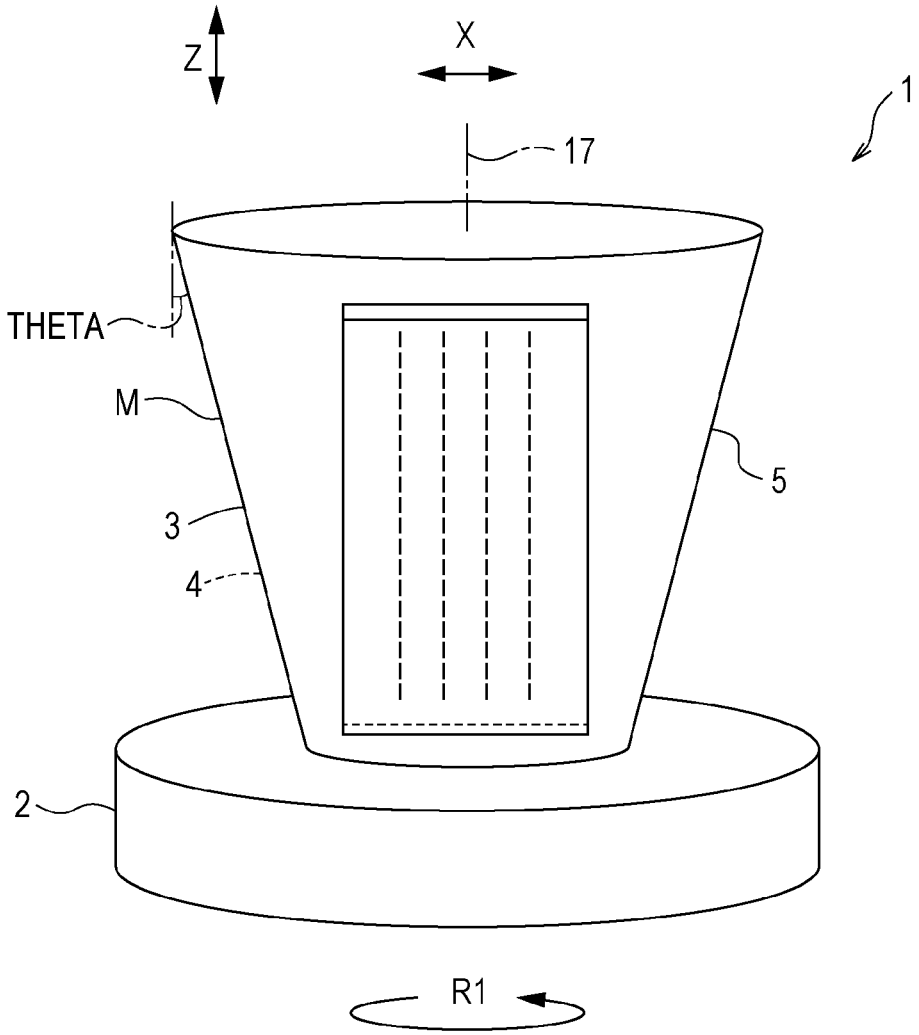

[Fig. 8]
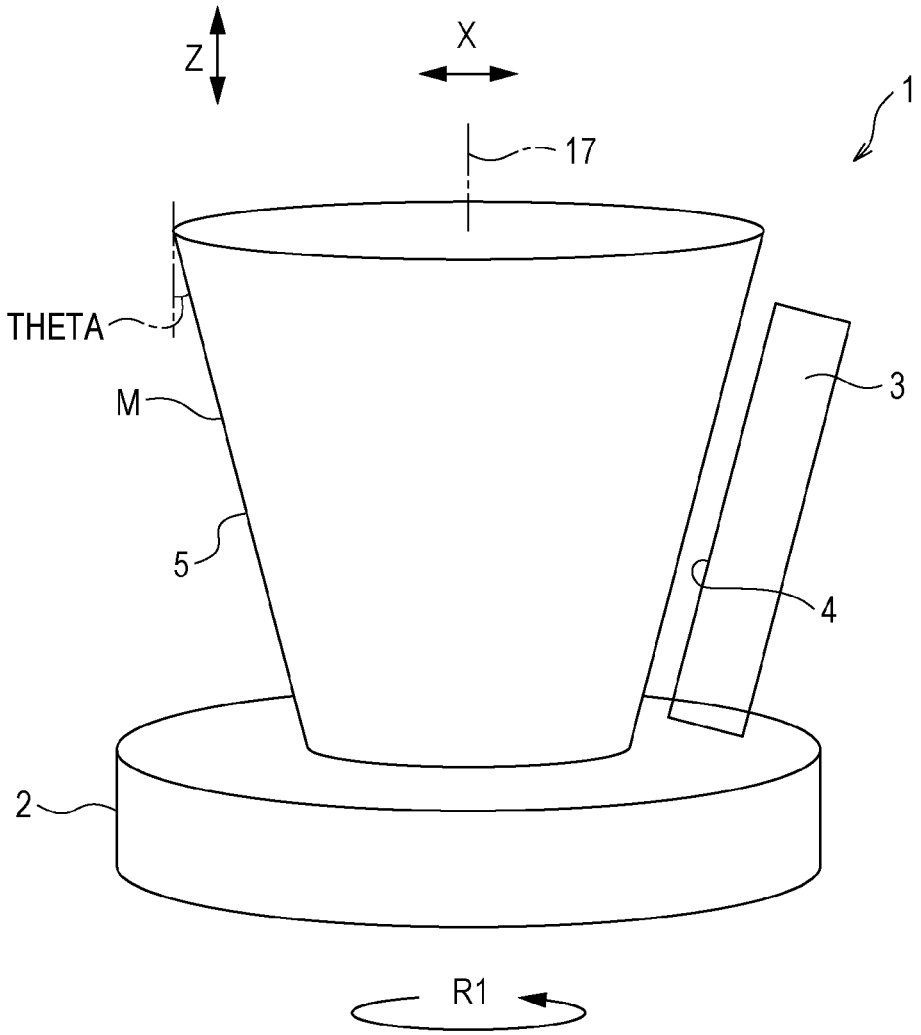

[Fig. 9]
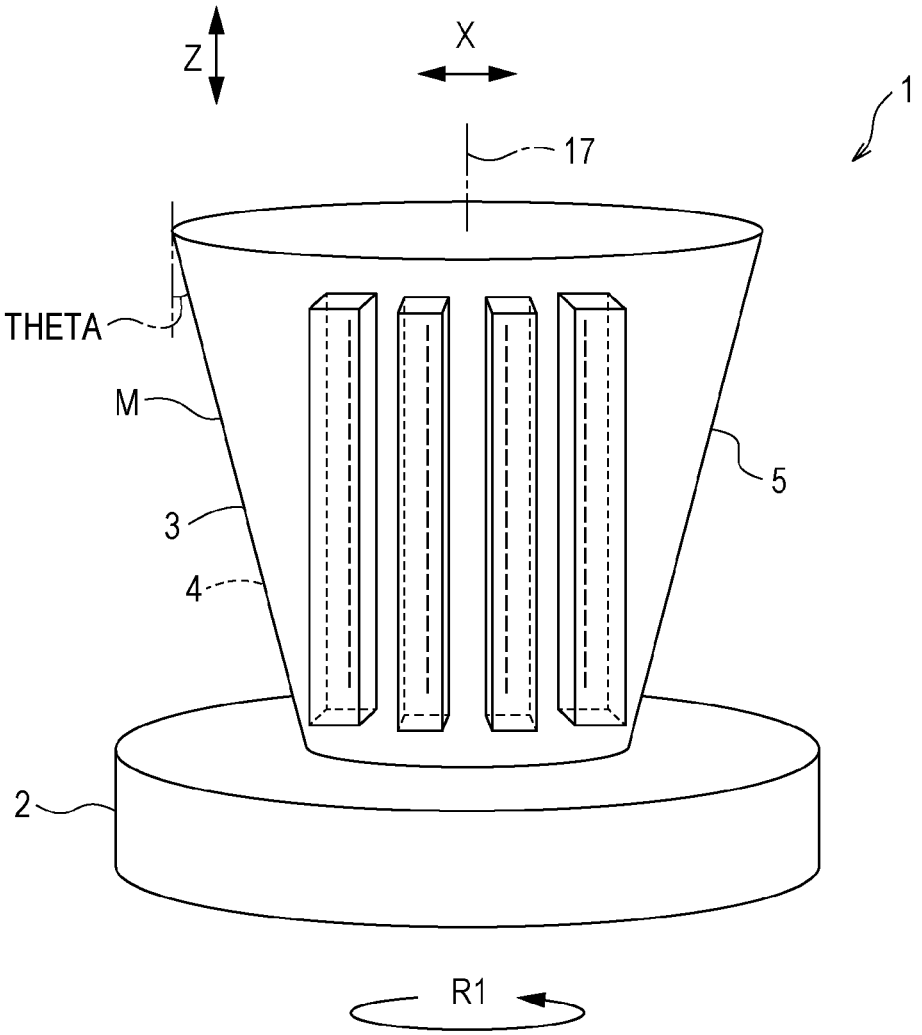

[Fig. 10]
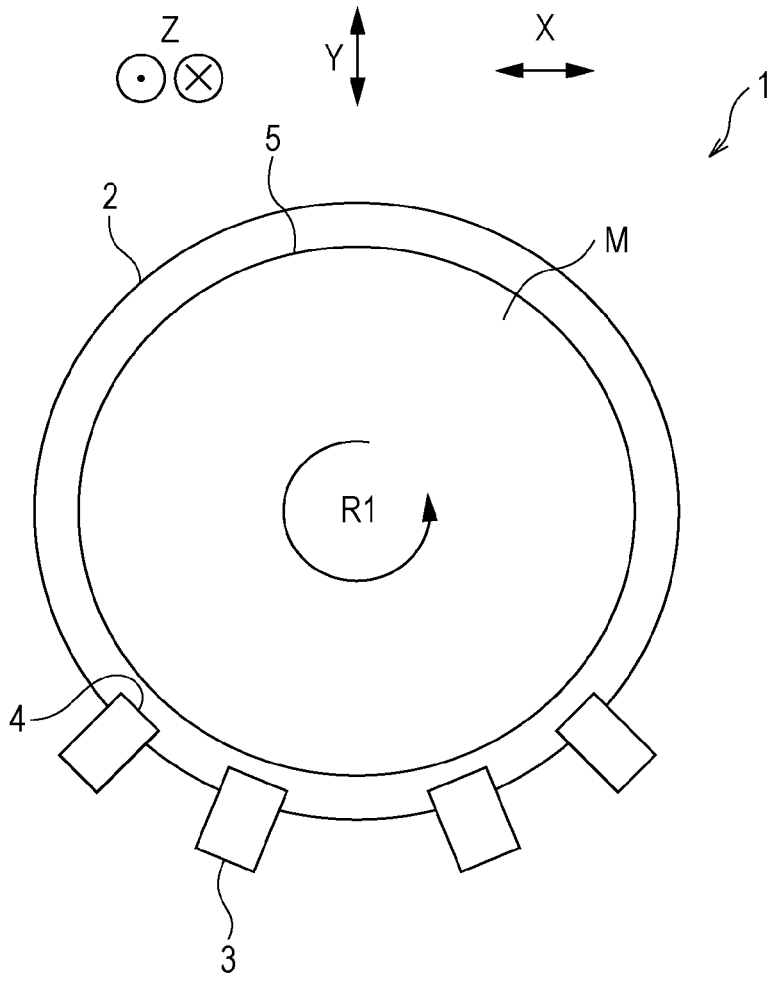

[Fig. 11]
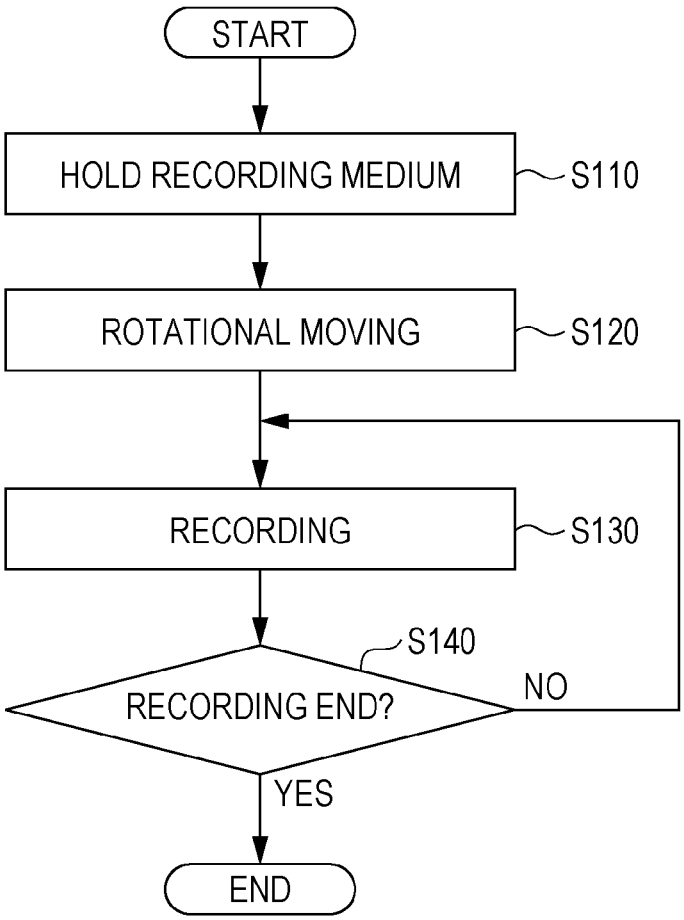

LIQUID DISCHARGE DEVICE AND LIQUID DISCHARGE METHOD

The entire disclosure of Japanese Patent Application No. 2014-148553, filed Jul. 22, 2014 is expressly incorporated by reference herein.

TECHNICAL FIELD

The present invention relates to a liquid discharge device and a liquid discharge method.

BACKGROUND ART

Conventionally, liquid discharge devices are used, which discharge liquid to a medium and form a discharged liquid material. Liquid may be discharged to various-shaped media by using such a liquid discharge device. For example, liquid may be discharged to a curved surface of a medium. PTL 1 discloses a liquid discharge device which is provided with a discharge unit that discharges liquid along a predetermined curvature and which can discharge liquid to a medium having the predetermined curvature.

Further, a liquid discharge device that discharges liquid by relatively rotating a medium and a liquid discharge unit is also used. However, for example, when liquid is discharged to a circumferential portion of a medium having a conic shape or a truncated conic shape by using such liquid discharge devices, a distance between adjacent droplets varies because a relative moving distance of the medium per unit time varies when the liquid is discharged, so that the quality of the discharged liquid material may degrade. In other words, the relative moving distance of the medium per unit time is large in a portion having a large diameter and the relative moving distance of the medium per unit time is small in a portion having a small diameter. Therefore, the distance between adjacent droplets is large in a portion having a large diameter and the distance between adjacent droplets is small in a portion having a small diameter, so that the quality of the discharged liquid material may degrade. Thus, for example, PTL 2 discloses a liquid discharge device which can adjust a diameter of discharged ink droplet according to the relative moving distance of the medium per unit time when the liquid is discharged.

CITATION LIST

Patent Literature

PTL 1: JP-A-2000-280567
PTL 2: JP-A-2006-335019

SUMMARY OF INVENTION

Technical Problem

However, it is difficult to improve adjustment accuracy of the diameter of droplet, so that it is desired for another method to suppress the degradation of the quality of the discharged liquid material caused by the difference of the relative moving distance between the medium and the discharge unit per unit time when the liquid is discharged.

Therefore, an object of the present invention is, in a liquid discharge device that discharges liquid while relatively rotating a medium and a discharge unit that discharges the liquid, to suppress the degradation of the quality of the discharged liquid material caused by the difference of the relative moving distance between the medium and the discharge unit per unit time when the liquid is discharged.

Solution to Problem

A liquid discharge device of a first aspect of the present invention to solve the above problem is characterized by including a discharge unit that discharges liquid from nozzles to a medium, a rotating mechanism that relatively rotationally moves the medium and the discharge unit around a rotation axis direction crossing a discharge direction of the liquid, and a control unit that controls a discharge frequency of the liquid according to a relative moving distance between the medium and the discharge unit per unit time.

In the first aspect, the liquid discharge device of a second aspect of the present invention is characterized by including a plurality of the discharge units and is characterized in that the control unit controls the discharge frequency for each discharge unit.

In the second aspect, the liquid discharge device of a third aspect of the present invention is characterized in that the discharge units are arranged in an arc shape as seen from the rotation axis direction.

In the second or the third aspect, the liquid discharge device of a fourth aspect of the present invention is characterized in that the discharge units are staggered arranged along the rotation axis direction.

In any one of the second to the fourth aspects, the liquid discharge device of a fifth aspect of the present invention is characterized in that the discharge units are arranged so that areas where the nozzles are provided overlap with each other as seen from a direction crossing the rotation axis direction.

In any one of the second to the fifth aspects, the liquid discharge device of a sixth aspect of the present invention is characterized in that at least either one of the position and the posture of the discharge unit can be adjusted.

In any one of the first to the sixth aspects, the liquid discharge device of a seventh aspect of the present invention is characterized in that the medium has a conic shape or a truncated conic shape.

A liquid discharge method of an eighth aspect of the present invention is characterized in that a liquid discharge device including a discharge unit that discharges liquid from nozzles to a medium is used, the medium and the discharge unit are relatively rotationally moved around a rotation axis direction crossing a discharge direction of the liquid, and the liquid is discharged by controlling a discharge frequency of the liquid according to a relative moving distance between the medium and the discharge unit per unit time.

Advantageous Effects of Invention

According to the present invention, in a liquid discharge device that discharges liquid while relatively rotating a medium and a discharge unit that discharges the liquid, it is possible to suppress the degradation of the quality of the discharged liquid material caused by the difference of the relative moving distance between the medium and the discharge unit per unit time when the liquid is discharged.

BRIEF DESCRIPTION OF DRAWINGS

FIG. 1 is a schematic perspective view illustrating a main portion of a recording device according to a first embodiment of the present invention.

FIG. 2 is a schematic plan view illustrating a main portion of the recording device according to the first embodiment of the present invention.

FIG. 3 is a block diagram illustrating the recording device according to the first embodiment of the present invention.

FIG. 4 is a graph for explaining the recording device according to the first embodiment of the present invention.

FIG. 5 is a graph for explaining the recording device according to the first embodiment of the present invention.

FIG. 6 is a schematic perspective view illustrating a main portion of a recording device according to a second embodiment of the present invention.

FIG. 7 is a schematic perspective view illustrating a main portion of a recording device according to a third embodiment of the present invention.

FIG. 8 is a schematic perspective view illustrating a main portion of the recording device according to the third embodiment of the present invention.

FIG. 9 is a schematic perspective view illustrating a main portion of a recording device according to a fourth embodiment of the present invention.

FIG. 10 is a schematic plan view illustrating a main portion of the recording device according to the fourth embodiment of the present invention.

FIG. 11 is a flowchart of an embodiment of a recording method of the present invention.

DESCRIPTION OF EMBODIMENTS

First Embodiment (FIGS. 1 to 5)

Hereinafter, a recording device, which is a liquid discharge device according to a first embodiment of the present invention, will be described in detail with reference to the attached drawings.

FIG. 1 is a schematic perspective view illustrating a main portion of a recording device 1 of the present embodiment. FIG. 2 is a schematic plan view illustrating a main portion of the recording device 1 of the present embodiment.

The recording device 1 according to the present embodiment includes a holding unit 2 that can hold a recording medium M (a medium) and rotate in a rotation direction R1. FIGS. 1 and 2 illustrate a state in which the holding unit 2 holds a recording medium M having a truncated conic shape with a taper angle THETA. The recording device 1 of the present embodiment has a configuration in which the recording medium M is mounted on the holding unit 2 in a direction Z and thereby the recording medium M is held by the holding unit 2. However, the recording device 1 is not limited to such a configuration. For example, the recording device 1 may have a configuration including a holding unit that has a fixture or the like that fixes the recording medium M.

When the recording device 1 of the present embodiment is mounted on a horizontal surface, a direction X and a direction y are horizontal directions and the direction X is a vertical direction.

The recording device 1 of the present embodiment has a plurality of recording heads 3 (five recording heads from a recording head 3*a* to a recording head 3*e*) as discharge units which discharge ink (liquid) from a plurality of nozzles 4 (nozzle arrays) to a circumferential portion 5 which is a recording surface of the recording medium M and therefore which can record on the circumferential portion 5. Here, the recording device 1 of the present embodiment can use color inks of black, cyan, magenta, and yellow as the ink, and also can use ink for forming an underlayer and ink for forming a protective layer that protects an image formed on the recording surface. All the nozzle arrays of the recording head 3 are extended in a direction crossing the rotation direction R1.

Each recording head 3 of the present embodiment has the same configuration. As illustrated in FIG. 1, the recording head 3 can rotationally move in a rotation direction R2 with respect to the recording device 1, and as illustrated in FIG. 2, the recording head 3 can move in a direction A in which the recording head 3 approaches and moves away from the recording medium M.

The recording device 1 of the present embodiment has such a configuration, so that the recording device 1 can perform recording on (discharge liquid to) the recording medium M having a truncated conic shape with various taper angles THETA while a distance (so-called PG) between the circumferential portion 5 and the nozzles 4 is maintained constant. Further, because of the configuration as described above, the recording device 1 can perform recording on the recording media M of various circumferential lengths.

In this manner, at least either one of the position and the posture of the recording head 3 can be adjusted, and thereby it is possible to perform recording on recording media having various sizes and shapes.

Although the recording device 1 according to the present embodiment has a configuration in which the recording medium M is rotationally moved with respect to the recording head 3, the recording device 1 only needs to have a configuration in which the recording medium M and the recording head 3 can be relatively rotationally moved. For example, the recording device 1 may have a configuration in which the holding unit 2 that holds the recording medium M is fixed and the recording head 3 is rotationally moved with respect to the fixed holding unit 2.

Further, even when the recording medium M has a complex shape, by inputting the shape of the recording medium M to the control unit 6 (see FIG. 3) through a PC 15 (see FIG. 3), the control unit 6 changes the position and the posture (angle) of the recording head 3 with respect to the recording medium M, so that the recording device 1 of the present embodiment can perform recording while the PG is maintained constant.

In the recording device 1 according to the present embodiment, as illustrated in FIG. 2, the recording heads 3 are arranged in an arc shape as seen from the direction Z which is a rotation axis direction of the holding unit 2 (a direction of a rotation axis 17). In this way, the space in the recording device 1 is effectively used and the size of the recording device 1 is reduced.

As illustrated in FIG. 1, the recording heads 3 are arranged so that areas where the nozzles are provided overlap with each other as seen from a direction crossing the direction Z which is the rotation axis direction. Specifically, in FIG. 1, the upper end of the nozzles 4 of the recording head 3*b* is located higher than the lower end of the nozzles 4 of the recording head 3*a*, the upper end of the nozzles 4 of the recording head 3*c* is located higher than the lower end of the nozzles 4 of the recording head 3*b*, the upper end of the nozzles 4 of the recording head 3*d* is located higher than the lower end of the nozzles 4 of the recording head 3*c*, and the upper end of the nozzles 4 of the recording head 3*e* is located higher than the lower end of the nozzles 4 of the recording head 3*d*. Therefore, it is possible to perform recording without a gap in the direction Z.

Next, an electrical configuration of the recording device 1 according to the present embodiment will be described.

FIG. 3 is a block diagram of the recording device 1 of the present embodiment.

The control unit 6 is provided with a CPU 7 that controls the entire recording device 1. The CPU 7 is connected to a ROM 9 that stores various control programs executed by the CPU 7 and a RAM 10 that can temporarily store date through a system bus 8.

Further, the CPU 7 is connected to a head driving unit 11 for driving the recording heads 3 through the system bus 8.

Further, the CPU 7 is connected to a motor driving unit 12 through the system bus 8. Here, the motor driving unit 12 is connected to a recording head moving motor 13, which is a discharge unit moving mechanism, and a holding unit driving motor 14 which is a rotating mechanism that relatively rotationally moves the recording medium M and the recording heads 3 around a rotation axis direction in the direction Z crossing ink discharge directions.

Here, the recording head moving motor 13 includes all motors that move the recording heads 3, such as a motor that moves the recording heads 3 in the direction A and a motor that rotationally moves the recording heads 3 in the rotation direction R2.

The holding unit driving motor 14 includes all motors that move the holding unit 2, such as a motor that moves the holding unit 2 in the rotation direction R1.

Further, the CPU 7 is connected to an input/output unit 16 through the system bus 8, and the input/output unit 16 is connected to the PC 15 where various information such as recording data and an instruction from a user can be inputted.

Because of such a configuration, when the control unit 6 of the present embodiment performs recording, the control unit 6 controls a discharge frequency of ink discharged from the recording head 3 according to the relative moving distance between the recording medium M and the recording head 3 per unit time (the relative moving distance between the recording medium M and the recording head 3). Specifically, for example, as in the present embodiment, when the control unit 6 performs recording on the circumferential portion 5 of the recording medium M having a truncated conic shape or performs recording on the circumferential portion 5 of the recording medium M having a conic shape, the control unit 6 prevents differences between distances between adjacent droplets (distances between adjacent ink dots) from varying greatly by increasing the discharge frequency at a portion whose diameter is large and decreasing the discharge frequency at a portion whose diameter is small according to the diameter of the circumferential portion 5 facing each nozzle 4. In this manner, the control unit 6 suppresses the degradation of quality of a recorded image (discharged liquid material) due to the difference of the moving distance of the recording medium M per unit time when the recording is performed.

Although in the present embodiment, the recording medium M having a truncated conic shape is used, the shape of the recording medium M is not limited to a conic shape and a truncated conic shape. The circumferential portion 5 of the recording medium M may have not only a shape formed by rotating a straight line around the rotation axis 17 without changing the distance between the straight line and the rotation axis 17, but also a shape formed by rotating a curved line instead of the straight line, a shape formed by rotating a combination of straight lines, or a shape formed by rotating a combination of curved lines and straight lines. Regarding the circumferential portion 5 of the recording medium M having various shapes, the control unit 6 recognizes the shape of the circumferential portion 5 by a sensor or the like not illustrated in the drawings, calculates the moving distance of the recording medium M per unit time from the recognition result for each nozzle 4, and controls the discharge frequency according to the moving distances, so that it is possible to use the recording medium M whose recording surface has not a circumferential shape.

Next, a suppressive effect of the variation of the distances between droplets of the recording device 1 of the present embodiment will be described.

FIG. 4 is a graph illustrating a correspondence between a position of the recording medium M from the lower side in the vertical direction (direction Z) and a driving frequency of the recording head 3 (the discharge frequency of ink) at the position when the recording is performed on the recording medium M whose taper angle THETA is 15 degrees by using the recording device 1 of the present embodiment. FIG. 5 is a graph illustrating a correspondence between a position of the recording medium M from the lower side in the vertical direction and a distance between adjacent droplets at the position when the recording is performed on the recording medium M whose taper angle THETA is 15 degrees by using the recording device 1 of the present embodiment.

A range of the position from 50 to 120 in the vertical direction corresponds to positions from the recording head 3*d* (the position of the lower end nozzle 4 corresponds to 50) to the recording head 3*b* (the position of the upper end nozzle 4 corresponds to 120).

Here, the marks in FIGS. 4 and 5 correspond to each other, and the marks (1) represented by a diamond shape indicate a case in which the distances between adjacent droplets are constant and the distances between adjacent droplets are ideal. In this case, as illustrated in FIG. 5, at any position in the vertical direction, the distance between adjacent droplets is constant and is 0.0175 mm. As illustrated in FIG. 4, the driving frequency in this case is proportional to the position in the vertical direction.

It is preferable to drive the recording head 3 so that the relationship between the position in the vertical direction and the driving frequency is as described above. However, to drive the recording head 3 in this manner, in all the recording heads 3 from the recording head 3*a* to the recording head 3*e*, the driving frequency has to be changed in the recording head 3. To change the driving frequency in the recording head 3, the configuration and the control method of the recording head 3 may be complicated, so that the recording device 1 of the present embodiment performs a drive control illustrated by the square marks in FIGS. 4 and 5 by the control unit 6.

Specifically, as illustrated by the square marks (2) in FIG. 4, the recording device 1 of the present embodiment performs a control in which the driving frequency is changed in stages with respect to the position in the vertical direction. More specifically, the change of the driving frequency in stages corresponds to each recording head 3 and the drive control is performed so that the driving frequency is held constant in each recording head 3 and the driving frequency increases in order of the recording head 3*e*, the recording head 3*d*, the recording head 3*c*, the recording head 3*b*, and the recording head 3*a*.

In the recording device 1 of the present embodiment, the drive control is performed in this manner, so that the distances between droplets are within a predetermined range as illustrated in FIG. 5.

The drive control illustrated by the triangle marks (3) in FIGS. 4 and 5 represents a case in which the driving frequency is constant at 15 KHz in all the recording heads 3. In this case, the difference between distances between droplets exceeds 0.01 mm in the range of 50 to 120 of the position in the vertical direction. On the other hand, when the drive control of the present embodiment illustrated by the square marks in FIGS. 4 and 5 is performed, the difference between distances between droplets is about 0.005 mm or less in the range of 50 to 120 of the position in the vertical direction.

In this way, the difference between distances between droplets is reduced to a half or less in a recording range from the recording head 3*d* to the recording head 3*b* by the drive control of the present embodiment as compared with the case in which the driving frequency is constant at 15 KHz. In a recording range from the recording head 3*e* to the recording head 3*a*, while the difference between distances between droplets further increases in the case in which the driving frequency is constant at 15 KHz, the difference between distances between droplets does not change in the case in which the drive control of the present embodiment is performed.

Second Embodiment (FIG. 6)

Next, a recording device 1 of a second embodiment will be described in detail with reference to the attached drawings.

FIG. 6 is a schematic perspective view illustrating a main portion of the recording device 1 of the second embodiment. The same components as those of the above embodiment are denoted by the same reference numerals, and the detailed description will be omitted.

The components of the recording device 1 of the present embodiment other than the recording heads 3 are the same as those of the recording device 1 of the first embodiment.

As illustrated in FIG. 6, in the recording device 1 of the present embodiment, the recording heads 3 are staggered arranged as seen from the direction Z which is the rotation axis direction of the holding unit 2. By employing such a simple configuration, a plurality of recording heads 3 are arranged so that areas where the nozzles 4 are provided overlap with each other as seen from a direction crossing the direction Z, so that it is possible to perform recording without a gap in the direction Z.

In the same manner as the recording head 3 of the first embodiment, it is possible to change the position and the posture of each recording head 3 of the present embodiment.

Third Embodiment (FIGS. 7 and 8)

Next, a recording device 1 of a third embodiment will be described in detail with reference to the attached drawings.

FIGS. 7 and 8 are schematic perspective views illustrating a main portion of the recording device 1 of the third embodiment seen from different angles, respectively. The same components as those of the above embodiments are denoted by the same reference numerals, and the detailed description will be omitted.

The components of the recording device 1 of the present embodiment other than the recording head 3 are the same as those of the recording device 1 of the first and the second embodiments.

The recording device 1 of the first and the second embodiments includes a plurality of recording heads 3, and the control unit 6 controls the discharge frequency of ink for each recording head 3. Therefore, it is not necessary to differentiate the discharge frequency of each nozzle 4 in the recording head 3, so that it is possible to simplify the configuration of the recording device 1 and easily control the discharge frequency. Further, the size of each recording head 3 is reduced by using a plurality of recording heads 3, so that the degree of freedom of the arrangement of the recording heads 3 in the recording device 1 is increased.

On the other hand, the recording device 1 of the present embodiment includes one recording head 3. The discharge frequency in the recording head 3 is differentiated by individually driving each block of a plurality of nozzles 4 of the one recording head 3 by the control of the control unit 6. By employing such a configuration, it is possible to suppress variation of ink discharge positions between a plurality of recording heads 3 due to variation of the mounting position of each of the plurality of recording heads 3.

In the same manner as the recording head 3 of the first and the second embodiments, it is possible to change the position and the posture of each recording head 3 of the present embodiment.

Fourth Embodiment (FIGS. 9 and 10)

Next, a recording device 1 of a fourth embodiment will be described in detail with reference to the attached drawings.

FIG. 9 is a schematic perspective view illustrating a main portion of the recording device 1 of the fourth embodiment. FIG. 10 is a schematic plan view illustrating a main portion of the recording device 1 of the fourth embodiment. The same components as those of the above embodiments are denoted by the same reference numerals, and the detailed description will be omitted.

The components of the recording device 1 of the present embodiment other than the recording heads 3 are the same as those of the recording device 1 of the first, the second, and the third embodiments.

Each of the recording heads 3 of the recording device 1 of the first, the second, and the third embodiments has the nozzles 4 corresponding to a plurality of types of ink and can discharge a plurality of types of ink.

On the other hand, the recording device 1 of the present embodiment is a recording device having a configuration to discharge a plurality of types of ink and perform recording by having a plurality of (four) recording heads 3 that can discharge one type of ink and causing each recording head 3 to discharge different ink. By employing such a configuration, it is possible to suppress the cost for replacing the recording head 3. This is because, for example, when an ink discharge failure occurs in only one type of ink in the recording device 1 of the third embodiment, the entire recording head 3 has to be replaced, however, in the recording device 1 of the present embodiment, only the recording head 3 where the discharge failure occurs can be replaced.

Embodiment of Recording Method (FIG. 11)

Next, an embodiment of a recording method (a liquid discharge method) using the recording device 1 of the first embodiment will be described.

FIG. 11 is a flowchart of the recording method of the present embodiment.

First, in a recording medium holding process in step S110, a user mounts the recording medium M on the holding unit 2 and causes the holding unit 2 to hold the recording medium M.

Subsequently, when recording data is inputted from the PC 15 to the control unit 6, in a rotational moving process in step S120, the recording device 1 rotationally moves the holding unit 2 that holds the recording medium M in the rotation direction R1. In the present embodiment, the recording device 1 of the first embodiment is used, so that the recording medium M is rotationally moved with respect to the recording heads 3. However, the recording medium M and the recording heads 3 only have to be relatively rotationally moved. For example, the holding unit 2 that holds the recording medium M is fixed and the recording heads 3 may be relatively rotationally moved with respect to the fixed holding unit 2.

Next, in a recording process in step S130, recording is performed by discharging desired ink from the recording heads 3 to the recording medium M that is being rotationally moved. Specifically, the recording is performed while the control unit 6 controls the discharge frequency of ink according to the moving distances of the recording medium M and the recording heads 3 per unit time. In the present embodiment, an image is formed by using black ink, cyan ink, magenta ink, and yellow ink. However, an underlayer, an overcoat layer, and the like may be further formed.

In a recording end determination process in step S140, it is determined whether or not recording based on the recording data ends, and if it is determined that the recording does not end, the process returns to the recording process in step S130, and if it is determined that the recording ends, the recording method of the present embodiment ends.

As described above, according to the recording method of the present embodiment, the recording is performed while the control unit 6 controls the discharge frequency of ink according to the moving distances of the recording medium M and the recording heads 3 per unit time, so that it is possible to suppress the degradation of quality of a recorded image due to the difference of the moving distance of the recording medium M per unit time when the recording is performed.

The present invention is not limited to the embodiments described above and various modifications can be made within a scope of the present invention described in the claims. It goes without saying that these modifications are also included in the scope of the present invention.

The specific embodiments of the present invention have been described in detail. Here, the present invention will be summarized and described again.

A liquid discharge device 1 of the first aspect of the present invention is characterized by including a discharge unit 3 that discharges liquid from nozzles 4 to a medium M, a rotating mechanism 14 that relatively rotationally moves the medium M and the discharge unit 3 around a rotation axis direction Z crossing a discharge direction of the liquid, and a control unit 6 that controls a discharge frequency of the liquid according to a relative moving distance between the medium M and the discharge unit 3 per unit time.

According to this aspect, the discharge frequency of the liquid is controlled according to the relative moving distance between the medium M and the discharge unit 3 per unit time. Specifically, for example, when discharging liquid to a circumferential portion of the medium M having a conic shape or a truncated conic shape, it is possible to reduce differences between distances between adjacent droplets by increasing the discharge frequency at a portion whose diameter is large and decreasing the discharge frequency at a portion whose diameter is small according to the diameter of the circumferential portion. Therefore, it is possible to suppress the degradation of quality of the discharged liquid material due to the difference of the relative moving distance of the medium M per unit time when the liquid is discharged.

In the first aspect, the liquid discharge device 1 of the second aspect of the present invention is characterized by including a plurality of discharge units 3 and is characterized in that the control unit 6 controls the discharge frequency for each discharge unit 3.

According to this aspect, the discharge frequency is controlled for each discharge unit 3. Therefore, it is not necessary to differentiate the discharge frequency of each nozzle 4 in the discharge unit 3, so that it is possible to simplify the configuration of the liquid discharge device 1. Further, it is possible to easily control the discharge frequency. Further, the size of the discharge unit 3 can be reduced, so that it is possible to increase the degree of freedom of arrangement of the discharge units 3 in the liquid discharge device 1.

In the second aspect, the liquid discharge device 1 of the third aspect of the present invention is characterized in that the discharge units 3 are arranged in an arc shape as seen from the rotation axis direction Z.

According to this aspect, the discharge units 3 are arranged in an arc shape as seen from the rotation axis direction Z. Therefore, the space in the liquid discharge device 1 can be effectively used and the size of the liquid discharge device 1 can be reduced.

In the second or the third aspect, the liquid discharge device 1 of the fourth aspect of the present invention is characterized in that the discharge units 3 are staggered arranged along the rotation axis direction Z.

According to this aspect, the discharge units 3 are staggered arranged along the rotation axis direction Z. Therefore, it is easy to arrange the discharge units 3 so that areas where the nozzles 4 are provided overlap with each other as seen from a direction crossing the rotation axis direction Z, so that it is possible to discharge liquid without a gap in the rotation axis direction Z.

In any one of the second to the fourth aspects, the liquid discharge device 1 of the fifth aspect of the present invention is characterized in that the discharge units 3 are arranged so that areas where the nozzles 4 are provided overlap with each other as seen from a direction crossing the rotation axis direction Z.

According to this aspect, the discharge units 3 are arranged so that areas where the nozzles 4 are provided overlap with each other as seen from a direction crossing the rotation axis direction Z. Therefore, it is possible to discharge liquid without a gap in the rotation axis direction Z.

In any one of the second to the fifth aspects, the liquid discharge device 1 of the sixth aspect of the present invention is characterized in that at least either one of the position and the posture of the discharge unit 3 can be adjusted.

According to this aspect, at least either one of the position and the posture of the discharge unit 3 can be adjusted. Therefore, it is possible to discharge liquid to media M having various sizes and shapes by adjusting at least either one of the position and the posture.

In any one of the first to the sixth aspects, the liquid discharge device 1 of the seventh aspect of the present invention is characterized in that the medium M has a conic shape or a truncated conic shape.

According to this aspect, the medium M has a conic shape or a truncated conic shape. Therefore, when the liquid is discharged to the medium M having a conic shape or a truncated conic shape, it is possible to suppress the degradation of quality of the discharged liquid material due to the difference of the relative moving distance of the medium M per unit time.

A liquid discharge method of the eighth aspect of the present invention is characterized in that a liquid discharge device 1 including a discharge unit 3 that discharges liquid from nozzles 4 to a medium M is used, the medium M and the discharge unit 3 are relatively rotationally moved around a rotation axis direction Z crossing a discharge direction of the liquid, and the liquid is discharged by controlling a discharge frequency of the liquid according to a relative moving distance between the medium M and the discharge unit 3 per unit time.

According to this aspect, the discharge frequency of the liquid is controlled according to the relative moving distance between the medium M and the discharge unit per unit time. Therefore, it is possible to suppress the degradation of quality of the discharged liquid material due to the difference of the relative moving distance of the medium M per unit time when the liquid is discharged.

REFERENCE SIGNS LIST

1 Recording device (Liquid discharge device)
2 Holding unit
3 Recording head (Discharge unit)
4 Nozzle
5 Circumferential portion that is a recording surface of a recording medium M
6 Control unit
7 CPU
8 System bus
9 ROM
10 RAM
11 Head driving unit
12 Motor driving unit
13 Recording head moving motor
14 Holding unit driving motor (Rotating mechanism)
15 PC
16 Input/output unit
17 Rotation axis
M Recording medium (Medium)
THETA Taper angle

The invention claimed is:

1. A liquid discharge device comprising:

a plurality of discharge units that discharge liquid from nozzles to a medium;

a rotating mechanism that relatively rotationally moves the medium and the plurality of discharge units around a rotation axis direction crossing a discharge direction of the liquid; and a control unit that controls to change a discharge frequency of the liquid in stages according to a relative moving distance between the medium and the plurality of discharge units per unit time, wherein each discharge unit of the plurality of discharge units is independently movable towards and away from the medium and is independently rotatable such that an orientation of each of the plurality of discharge units is independently controllable, with the plurality of discharge units being arranged along the rotation axis direction, the control unit controls the discharge frequency for each discharge unit.

2. The liquid discharge device according to claim 1, wherein the discharge units are arranged in an arc shape as seen from the rotation axis direction.

3. The liquid discharge device according to claim 1, wherein the discharge units are staggered arranged along the rotation axis direction.

4. The liquid discharge device according to claim 1, wherein the discharge units are arranged so that areas where the nozzles are provided overlap with each other as seen from a direction crossing the rotation axis direction.

5. The liquid discharge device according to claim 1, wherein at least either one of a position and a posture of the discharge unit can be adjusted.

6. The liquid discharge device according to claim 1, wherein the medium has a conic shape or a truncated conic shape.

7. A liquid discharge method using a liquid discharge device including a plurality of discharge units that discharge liquid from nozzles to a medium, the method comprising:

relatively rotationally moving the medium and the plurality of discharge units around a rotation axis direction crossing a discharge direction of the liquid, each discharge unit being independently movable, discharging liquid by controlling to change a discharge frequency of the liquid in stages according to a relative moving distance between the medium and the plurality of discharge units per unit time, wherein plurality of discharge units are arranged along the rotation axis direction and discharging liquid by controlling the discharge frequency for each discharge unit, and independently controlling a position of each of the plurality of discharge units in a direction towards and away from the medium, and independently controlling an orientation of each of the plurality of discharge units.

* * * * *